US007432668B2

(12) United States Patent
Zwanenburg et al.

(10) Patent No.: US 7,432,668 B2
(45) Date of Patent: Oct. 7, 2008

(54) SENSING LIGHT EMITTED FROM MULTIPLE LIGHT SOURCES

(75) Inventors: Michel J. Zwanenburg, Northville, MI (US); James M. Gaines, Mohegan Lake, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 146 days.

(21) Appl. No.: 10/539,980

(22) PCT Filed: Dec. 12, 2003

(86) PCT No.: PCT/IB03/05983

§ 371 (c)(1),
(2), (4) Date: Jun. 19, 2005

(87) PCT Pub. No.: WO2004/057923

PCT Pub. Date: Jul. 8, 2004

(65) Prior Publication Data

US 2006/0061288 A1 Mar. 23, 2006

Related U.S. Application Data

(60) Provisional application No. 60/435,243, filed on Dec. 20, 2002.

(51) Int. Cl.
*H05B 37/00* (2006.01)

(52) U.S. Cl. ..... 315/312; 315/312; 315/291

(58) Field of Classification Search ..... 315/159, 315/149, 291, 312
See application file for complete search history.

(56) References Cited

U.S. PATENT DOCUMENTS

| | | | | |
|---|---|---|---|---|
| 3,439,269 | A | 4/1969 | Fuchs et al. | |
| 5,192,856 | A * | 3/1993 | Schaham | 235/462.24 |
| 6,055,251 | A | 4/2000 | Ouchi et al. | |
| 6,753,661 | B2 * | 6/2004 | Muthu et al. | 315/307 |
| 6,998,594 | B2 * | 2/2006 | Gaines et al. | 250/205 |
| 2002/0070688 | A1 * | 6/2002 | Dowling et al. | 315/312 |
| 2003/0137258 | A1 * | 7/2003 | Piepgras et al. | 315/291 |

FOREIGN PATENT DOCUMENTS

EP 0296609 A2 12/1988

* cited by examiner

*Primary Examiner*—Trinh V Dinh

(57) ABSTRACT

An apparatus is directed to controlling a light source. The apparatus provides at least one light source that emits a light signal at a discrete frequency and a reference signal at the discrete frequency. The apparatus further includes a photodetector optically coupled to the light source and designed to receive the light signal. The apparatus additionally includes at least one lock-in system coupled to the photodetector and each light source that receives the light signal from the photodetector and receives the reference signal from the light source. Each lock-in system produces an intensity value of the light source based on the light signal and the reference signal. The lock-in system may include a frequency multiplier and a filter coupled to the frequency multiplier wherein the intensity value is the product of the light signal and the reference signal processed through the frequency multiplier, and filtered to remove non-dc portions.

16 Claims, 5 Drawing Sheets

SENSING LIGHT EMITTED FROM MULTIPLE LIGHT SOURCES

CROSS REFERENCE TO RELATED APPLICATION

This application claims the benefit of U.S. provisional Application Ser. No. 60/435,243, filed Dec. 20, 2002, which is incorporated herein by reference.

The technical field of this disclosure is light production from light emitting diodes (LEDs), particularly, sensing light emitted simultaneously from multiple light sources.

Illumination sources, such as lamps, currently utilize incandescent and fluorescent means as light production. It is well known that incandescent light sources are inefficient light sources that utilize more power resources than other light sources. Fluorescent light sources have provided a more efficient light production.

Light emitting diodes (LEDs) produce light in a much more efficient manner than incandescent light sources, but until recently have not been manufactured in a cost efficient manner to utilize in lighting applications. Expectations are for LEDs to produce light more efficiently than fluorescent light sources in the near future. Recently, LED production has made utilizing LEDs in light production applications a viable alternative.

Producing usable light with LEDs generally requires either manufacturing an LED that produces a specified color, such as utilizing a phosphor layer overlying the LED, or mixing a plurality of colored LEDs to produce a desired colored light output. Unfortunately, once a light source package is produced to achieve the desired colored light output its useful life is reduced to the amount of time until a failure or partial failure of one of its component parts occurs.

Unfortunately, LED characteristics depend on temperature, drive current, and time. Additionally, LED characteristics vary from LED to LED. Although an LED-based lamp may be set to operate at a given color point and intensity, at the beginning of its life, the actual color and intensity obtained at that setting may not remain constant.

Mixing a plurality of colored light sources may include a control system that varies individual light source contributions to correct for variation in the LED characteristics That is, as the output of component LEDs varies, the control system can maintain a desired spectral output and intensity by varying individual LED output to compensate for the variations.

Currently, sensing systems for controlling a specified colored light output include temperature feed-forward or intensity feedback systems containing a single unfiltered photodiode. Another sensing system includes utilizing multiple photodiodes, for example three or more, and corresponding color filters. This system may be referred to as a color filter photodiode control system.

In one embodiment, this system can be implemented utilizing a time-based approach whereby the LEDs are pulsed on and off in a particular pattern allowing the sensing of the intensity of the independent LED groups. An advantage of the color filter photodiode control system over the temperature feed-forward or intensity feedback systems is that the color filter photodiode control system can sense the average levels of the different spectral outputs of the LEDs, for example red, green, and blue, without having to turn the LEDs on and off in a particular pattern. Additionally, a low pass filter can be used to integrate the signal from each LED group. The accuracy of this method is strongly influenced by the color filters on the photodiodes.

Unfortunately, as described above, temperature feed-forward or intensity feedback systems require that LEDs be turned on and off briefly to permit sensing of the individual color components, for example red, green and blue. This approach is susceptible to errors resulting from ripple in the driving current, and changes in the drive waveform, such as, for example changes in the rise and fall times of the LED drive current pulses. The color filter photodiode control system, although not requiring the turning on and off of LEDs to sense the individual color components, does require more expensive sensors containing color filters as well as a larger total number of sensors. None of the systems corrects for ambient light.

It would be desirable, therefore, to provide a system that would overcome these and other disadvantages.

The present invention is directed to an apparatus and method for controlling a light source. The invention provides for a frequency sensing structure that produces an intensity value input for a control system.

One aspect of the invention provides a light source control apparatus including at least one light source that emits a light signal at a discrete frequency and a reference signal at the discrete frequency. The apparatus further includes a photodetector optically coupled to the light source and designed to receive the light signal. The apparatus additionally includes at least one lock-in system coupled to the photodetector and each light source, to receive the light signal from the photodetector and an associated reference signal from the light source. Each lock-in system produces an intensity value of the light source based on the light signal and the associated reference signal.

In accordance with another aspect of the invention, the invention provides a method for sensing intensity of a light source. The method includes emitting at least one light signal where the light source is driven at a discrete frequency. The method further includes transmitting a reference signal associated with each of the light signals at the discrete frequency. The method additionally includes producing an intensity value based on the light signal and the associated reference signal.

In accordance with yet another aspect of the invention, the invention provides a system for sensing intensity of a light source. The system includes means for emitting at least one light signal where the light source is driven at a discrete frequency. The system further includes means for transmitting a reference signal associated with each of the light signals at the discrete frequency. Means for producing an intensity value based on the light signal and the associated reference signal are also included.

The foregoing and other features and advantages of the invention will become further apparent from the following detailed description of the presently preferred embodiment, read in conjunction with the accompanying drawings. The detailed description and drawings are merely illustrative of the invention rather than limiting, the scope of the invention being defined by the appended claims and equivalents thereof.

Throughout the specification, and in the claims, the term "connected" means a direct physical or optical connection between the things that are connected, without any intermediate devices. The term "coupled" means either a direct physical or optical connection between the things that are connected or an indirect connection through one or more passive or active intermediary devices. The term "circuit" means either a single component or a multiplicity of components, either active or passive, that are coupled together to perform a desired function.

Figure 1:
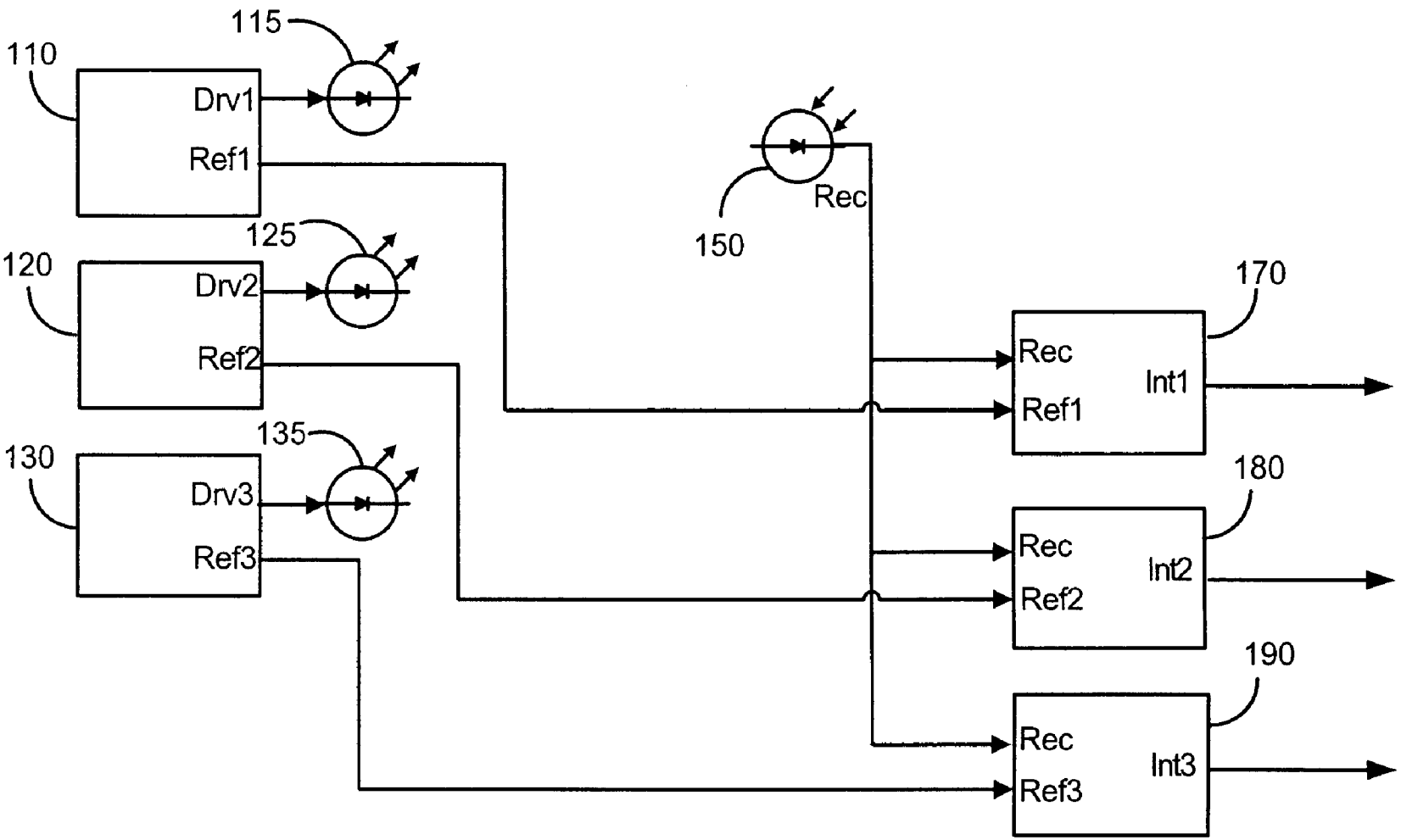
FIG. 1 is a schematic diagram illustrating a sensing device according to an embodiment of the present invention.

FIG. 1 is a schematic diagram illustrating a sensing device 100 according to an embodiment of the present invention. Device structure 100 includes control units (110, 120, and 130), light emitting diodes (115, 125 and 135), a photodetector 150, and lock-in systems (170, 180, and 190). In one embodiment, implementation of the present invention allows any number of light emitting diodes (LEDs) to be utilized, so long as there is a corresponding control unit and lock-in system for each LED. In another embodiment, each LED represents a block of independently-driven LEDs with a substantially similar spectral light output. For example, LED 115 may consist of several LEDs, all emitting a red light output. Similarly, LED 125 may include all green light emitting LEDs, and LED 135 may include all blue light emitting LEDs.

In one example, the present invention is implemented as a single LED or a single color group of LEDs, a single control unit, and a single lock-in unit in addition to the photodetector. In another example and referring to FIG. 1, sensing device 100 is implemented as a plurality of LEDs or multi-color LED groups, each independently-driven LED or LED group having an associated control unit and an associated lock-in system. In this example, emitted spectra of the LEDs form a multi-source light signal. For example, a red, a green, and a blue LED or groups of LEDs are utilized to produce a "white" multi-source light signal.

Each control unit (110, 120, and 130), detailed in FIG. 2 below, includes an associated output drive signal terminal (Drv1, Drv2, and Drv3) and an associated output reference terminal (Ref1, Ref2, and Ref3). Each output drive signal terminal (Drv1, Drv2, and Drv3) is coupled to an associated light emitting diode (115, 125 and 135).

In an example, output drive signal terminal (Drv1) is coupled to light emitting diodes (115), output drive signal terminal (Drv2) is coupled to light emitting diode (125), and output drive signal terminal (Drv3) is coupled to light emitting diode (135).

Light emitting devices (115, 125 and 135) are optoelectronic devices that produce light when power is supplied causing them to forward bias. The light produced may be within the blue, green, red, amber or other portion of the spectrum, depending on the material utilized in manufacturing the LED. In an example, LEDs (115, 125 and 135) are implemented as LXHL-BM01, LXHL-BB01 and LXHL-BD01 available from Lumileds corporation of San Jose, Calif. In another example, LEDs (115, 125 and 135) are implemented as NSPB300A, NSPG300A and NSPR800AS from Nichia corporation of Mountville, Pa.

Each control unit produces a drive signal and a reference signal, as detailed in FIG. 2 below. Power, in the form of the drive signal, is transmitted to the associated light emitting diode (LED) or LED group and the reference signal is transmitted to the associated lock-in unit. The LED receives the drive signal and produces a light signal based on the drive signal. The drive signal is generated at a discrete frequency.

The reference signal is transmitted to the associated lock-in system and includes the same discrete frequency. Multiple control units and associated LEDs produce a light signal including several intensity values representing the intensity of light emitted by each LED or LED group.

It is important to differentiate between the discrete frequency driving the light signal emitting from each LED or LED group and the very high frequency that the LED or LED group emit as light. Typically, as described below, the drive signals range from about 400 Hz to about 1.2 kHz while the light emitted from the LEDs or LED groups is in the order of $10^{14}$ Hz.

Photodetector 150 is an optoelectronic device that responds to light signals and produces a received light signal. In one embodiment, photodetector 150 is implemented as a photodiode, such as, for example PS 1-2CH from Pacific Silicon Sensor, Inc of Westlake village, Calif. Photodetector 150 includes an output signal terminal (Rec) for supplying the received light signal.

In one embodiment, photodetector 150 responds to a single source light signal and produces a received light signal, at the output signal terminal (Rec), which corresponds to the intensity of light produced by that single light source. In another embodiment and described in FIG. 5 below, photodetector 150 responds to the multi-source light signal and produces a received light signal, at the output signal terminal (Rec). The received light signal includes components at multiple frequencies, each component corresponding to the intensity of one light source in the multi-source light signal.

Each lock-in system (170, 180, and 190) includes a lock-in device, detailed in FIG. 3 below. Each lock-in system (170, 180, and 190) further includes an input signal terminal (Rec) and an associated input reference terminal (Ref1, Ref2, and Ref3). Each input signal terminal (Rec) of each associated lock-in system (170, 180, and 190) is coupled to the output signal terminal (Rec) of photodetector 150. Each input reference terminal (Ref1, Ref2, and Ref3) of each associated lock-in system (170, 180, and 190) is coupled to the output reference terminal (Ref1, Ref2, and Ref3) of each associated control unit (110, 120, and 130).

In an example, output reference terminal (Ref1) of control unit 110 is coupled to input reference terminal (Ref1) of lock-in system 170, output reference terminal (Ref2) of control unit 120 is coupled to input reference terminal (Ref1) of lock-in system 180, and output reference terminal (Ref3) of control unit 130 is coupled to input reference terminal (Ref3) of lock-in system 190.

Each lock-in system (170, 180, and 190) further includes an associated output intensity signal terminal (Int1, Int2, and Int3), detailed in FIG. 3 below. Each lock-in system receives an input signal, at the input signal terminal (Rec), from photodetector 150 and a reference signal, at the input reference terminal (Ref1, Ref2, and Ref3), from an associated control unit (110, 120, and 130). Each lock-in system produces an output intensity signal, at the associated output intensity signal terminal (Int1, Int2, and Int3), based on the received input signal and reference signal.

In a further embodiment, sensing device 100 includes a high-pass filter coupled between the output reference terminal (Ref1, Ref2, and Ref3) of each control unit (110, 120, and 130) and the input reference terminal (Ref1, Ref2, and Ref3) of the associated lock-in system (170, 180, and 190). In one embodiment, coupling a high-pass filter between the control unit and the lock-in system reduces spurious dc components from affecting the reference signal.

Figure 2:
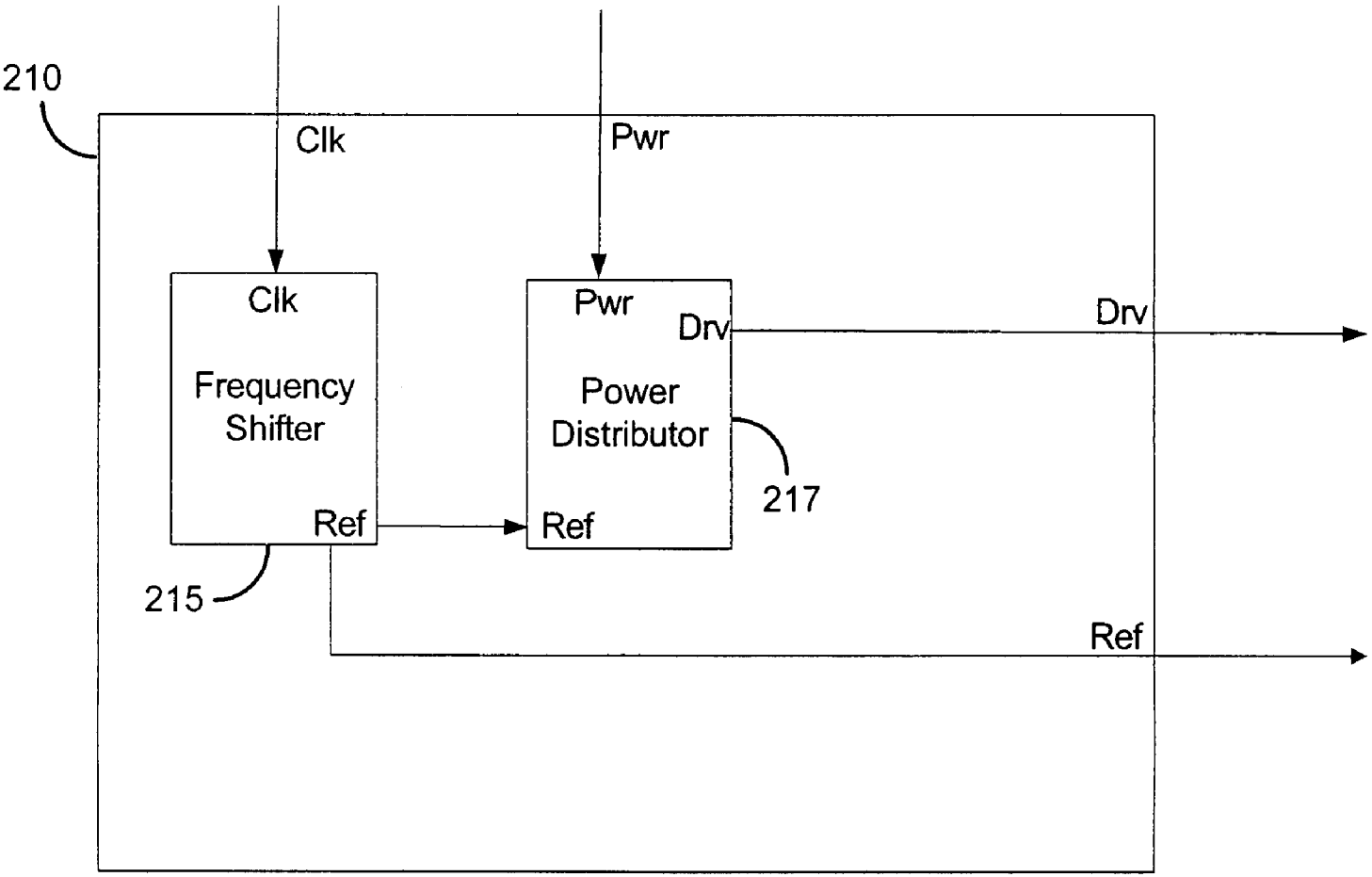
FIG. 2 is a schematic diagram illustrating a portion of the sensing device in FIG. 1 according to an embodiment of the present invention.

FIG. 2 is a schematic diagram illustrating a control unit 210 according to an embodiment of the present invention. Control unit 210 includes a frequency shifter 215, a power distributor 217, an input clock signal terminal (Clk), an input power signal terminal (Pwr), an output reference signal terminal (Ref), and an output drive signal terminal. Control unit 210 receives a clock signal and a power signal, produces a reference signal based on the clock signal, and produces a drive signal based on the reference signal and the power signal.

Frequency shifter 215 includes an input clock signal terminal (Clk) and an output reference signal terminal (Ref). Frequency shifter 215 receives the clock signal and produces the reference signal based on the clock signal. In one embodiment, frequency shifter 215 receives the clock signal and "divides down" the clock signal to produce the reference signal. The reference signal frequency utilized is produced at a frequency so as not to cause noticeable "flicker" to the human eye. In an example, a reference signal is produced in the 100 Hz-2.4 kHz range.

In another embodiment, frequency shifter 215 includes an internal clock that generates the clock signal internally thereby eliminating the need for the clock terminal (Clk).

Additionally and referring to FIG. 1, the use of multiple control units (110, 120, and 130) requires several discrete frequencies. The frequencies utilized are produced so that frequency overlap will not occur. In one embodiment, the frequencies utilized are produced with a 100 Hz gap between discrete frequencies. In an example, control unit 110 produces a reference frequency at 400 Hz, control unit 120 produces a reference frequency at 500 Hz, and control unit 130 produces a reference frequency at 600 Hz.

Power distributor 217 includes an input power terminal (Pwr), an input reference signal terminal (Ref), and an output drive signal terminal (Drv). The input reference terminal (Ref) of power distributor 217 is coupled to the output reference terminal (Ref) of frequency shifter 215. Power distributor 217 receives the power signal and the reference signal and produces the drive signal based on the power signal and the reference signal.

In one embodiment, the power signal is implemented as a voltage source signal. In another embodiment, the power signal is implemented as a current source signal. In an example, power distributor 217 produces a drive signal including a current signal modulated at a discrete frequency associated with the reference signal.

The power signal may be produced in the form of one of several different waveforms, such as, for example, a sine wave, a cosine wave, a square wave, or any other waveform that would allow the production of the light signal.

Figure 3:
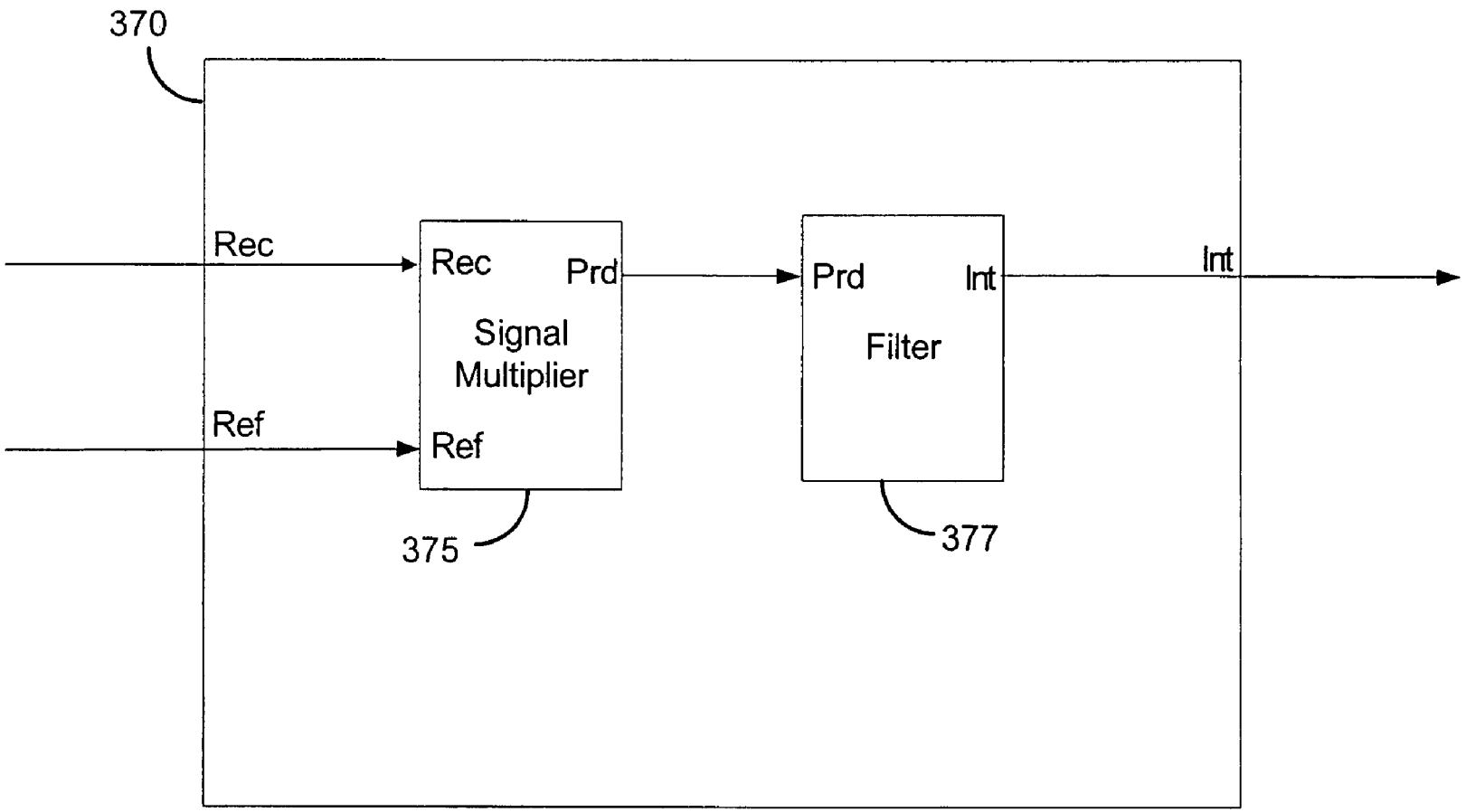
FIG. 3 is a schematic diagram illustrating another portion of the sensing device in FIG. 1 according to an embodiment of the present invention.

FIG. 3 is a schematic diagram illustrating a lock-in device 370 according to an embodiment of the present invention. Lock-in device 370 includes a signal multiplier 375, a filter 377, an input signal terminal (Rec), an input reference terminal (Ref), and an output intensity terminal (Int). Lock-in device 370 receives an input signal and a reference signal, and produces an intensity signal based on the input signal and the reference signal.

Signal multiplier 375 includes an input signal terminal (Rec), an input reference terminal (Ref), and an output product terminal (Prd). Signal multiplier 375 receives the input signal and the reference signal, and produces a product signal based on the input signal and the reference signal. Signal multiplier 375 produces the product signal by multiplying the input signal by the reference signal, detailed in FIG. 5 below. Signal multiplier 375 can be implemented as a signal multiplier chip, such as, for example the MLT04 produced by Analog Devices of Norwood, Mass.

Filter 377 includes an input product terminal (Prd) and an output intensity terminal (Int). The input product terminal (Prd) of filter 377 is coupled to the output product terminal (Prd) of signal multiplier 375. Filter 377 receives the product signal and filters the received product signal to remove non-dc portions of the signal. In one embodiment, filter 377 is implemented as a low-pass filter.

Figure 4:
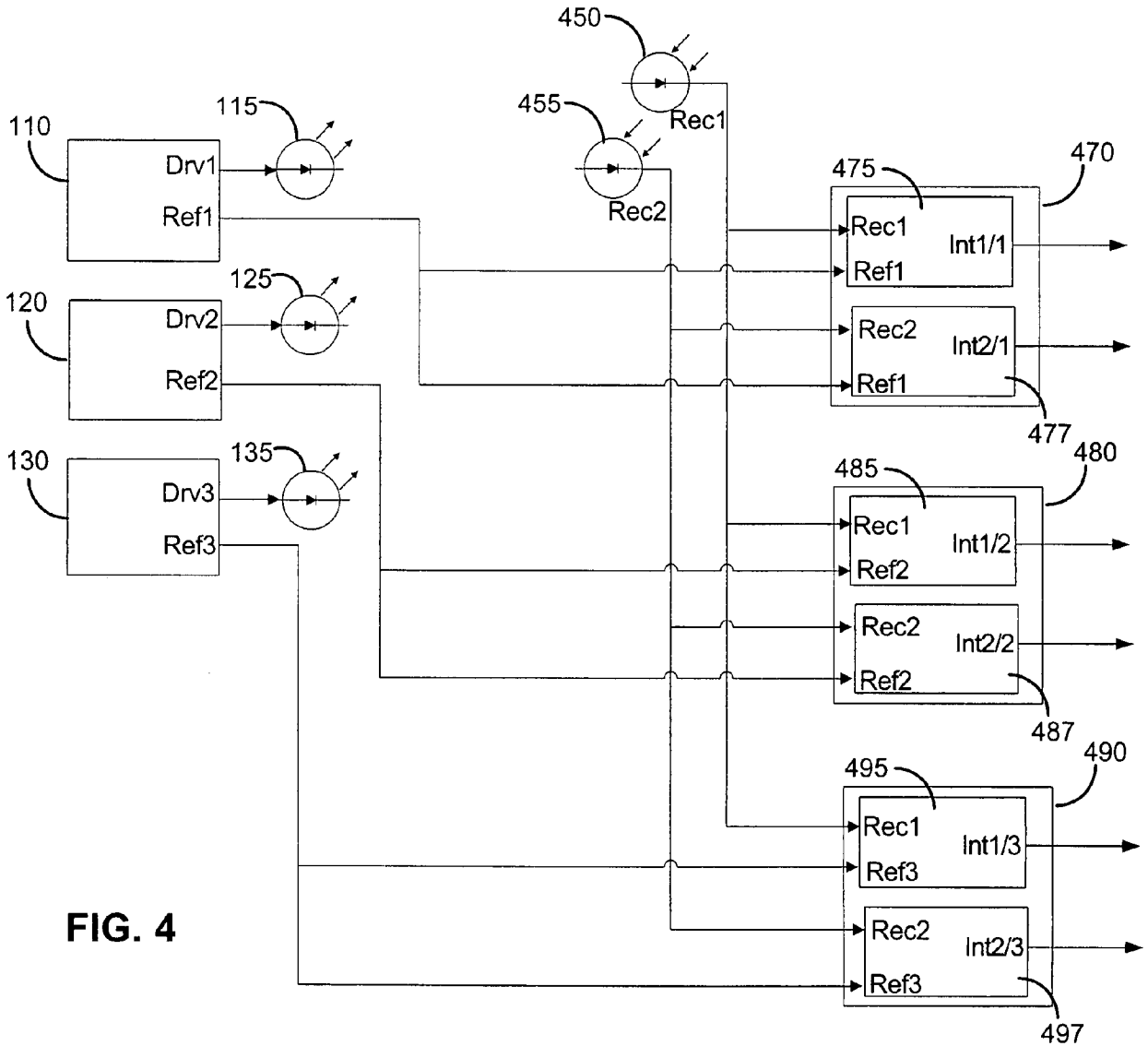
FIG. 4 is a schematic diagram illustrating a sensing device according to another embodiment of the present invention.

FIG. 4 is a schematic diagram illustrating a sensing device 400 according to another embodiment of the present invention. Device structure 400 includes control units (110, 120, and 130), light emitting diodes (115, 125 and 135), photodetectors 450 and 455, and lock-in systems (470, 480, and 490). Like components from FIG. 1 are numbered identically and function identically. In one embodiment, implementation of the present invention allows any number of light emitting diodes (LEDs) to be utilized, so long as there is a corresponding control unit and lock-in system for each independently driven LED or group of LEDs.

Photodetectors 450 and 455 are optoelectronic devices that respond to light signals across the whole visible spectrum, and each produce a received light signal within a predetermined spectrum. In one embodiment, photodetectors 450 and 455 are implemented as two separate single junction photodiodes, such as, for example PSS 1-2CH from Pacific Silicon Sensor, Inc. In this embodiment, photodetector 450 includes an output signal terminal (Rec1) for supplying a portion of the received light signal, and photodetector 455 includes an output signal terminal (Rec2) for supplying another portion of the received light signal.

In another embodiment, photodetectors 450 and 455 are implemented as a multi-junction photodiode, such as, for example PSS-WS7.56 from Pacific Silicon Sensor, Inc. In this embodiment, photodetector 450 represents a first junction of the multi-junction photodiode, and photodetector 455 represents a second junction of the multi-junction photodiode. One junction is more sensitive to red wavelengths, and the other is more sensitive to blue wavelengths. Comparison of the measurements of the two junctions provides a measure of spectral shift.

In an example, photodetector 450 responds more strongly than photodetector 455 to light signals within the spectrum defined as greater than about 600 nm. In this example, photodetector 455 responds most strongly than photodetector 450 to light signals within the spectrum defined as less than about 600 nm.

Photodetectors 450 and 455 respond to single and multi-source light signals and produce a received light signal, at the output signal terminals (Rec1 and Rec2). In one embodiment, each received light signal includes single or multiple intensity values. In this embodiment, each intensity value includes a discrete frequency.

In another embodiment each received light signal includes components at single or multiple frequencies. In this embodiment, each component corresponds to the intensity of one light source in the multi-source light signal.

Each lock-in system (470, 480, and 490) includes multiple lock-in devices (475, 477, 485, 487, 495, and 497), each lock-in device functions as described in FIG. 3 above. In one embodiment, the number of lock-in devices within each lock-in system is equal to the number of photodetectors. In an example, lock-in devices (475, 485, and 495) are coupled to photodetector 450 via input signal terminal (Rec1), and lock-in devices (477, 487, and 497) are coupled to photodetector 455 via input signal terminal (Rec2).

Each lock-in system (470, 480, and 490) further includes associated input reference terminals (Ref1, Ref2, and Ref). Input reference terminals (Ref1, Ref2, and Ref3) of each associated lock-in system (470, 480, and 490) are coupled to the output reference terminal (Ref1, Ref2, and Ref3) of each associated control unit (110, 120, and 130). In an example, output reference terminal (Ref1) of control unit 110 is coupled to each input reference terminal (Ref1) of lock-in devices (475 and 477) within lock-in system 470. Output reference terminal (Ref2) of control unit 120 is coupled to input reference terminal (Ref1) of lock-in devices (485 and 487) within lock-in system 480. Output reference terminal (Ref3) of control unit 130 is coupled to input reference terminal (Ref3) of lock-in devices (495 and 497) within lock-in system 490.

Each lock-in device (475, 477, 485, 487, 495, and 497) further includes multiple output intensity signal terminals (Int1/1, Int2/1, Int1/2, Int2/2, Int1/3, and Int2/3). In one embodiment, the number of output intensity signal terminals within each lock-in system is equal to the number of lock-in devices, and therefore is equal to the number of photodetectors.

Each lock-in device receives a portion of the received light signal from an associated photodetector, and receives a reference signal from an associated control unit. Each lock-in system produces an output intensity signal, at the associated output intensity signal terminal (Int1/1, Int2/1, Int1/2, Int2/2, Int1/3, and Int2/3), based on the received input signal and reference signal.

In a further embodiment, sensing device 100 includes a high-pass filter coupled between the output reference terminal (Ref1, Ref2, and Ref3) of each control unit (110, 120, and 130) and the input reference terminal (Ref1, Ref2, and Ref3) of the associated lock-in system (470, 480, and 490). In one embodiment, coupling a high-pass filter between the control unit and the lock-in system reduces spurious dc components from affecting the reference signal.

Figure 5:
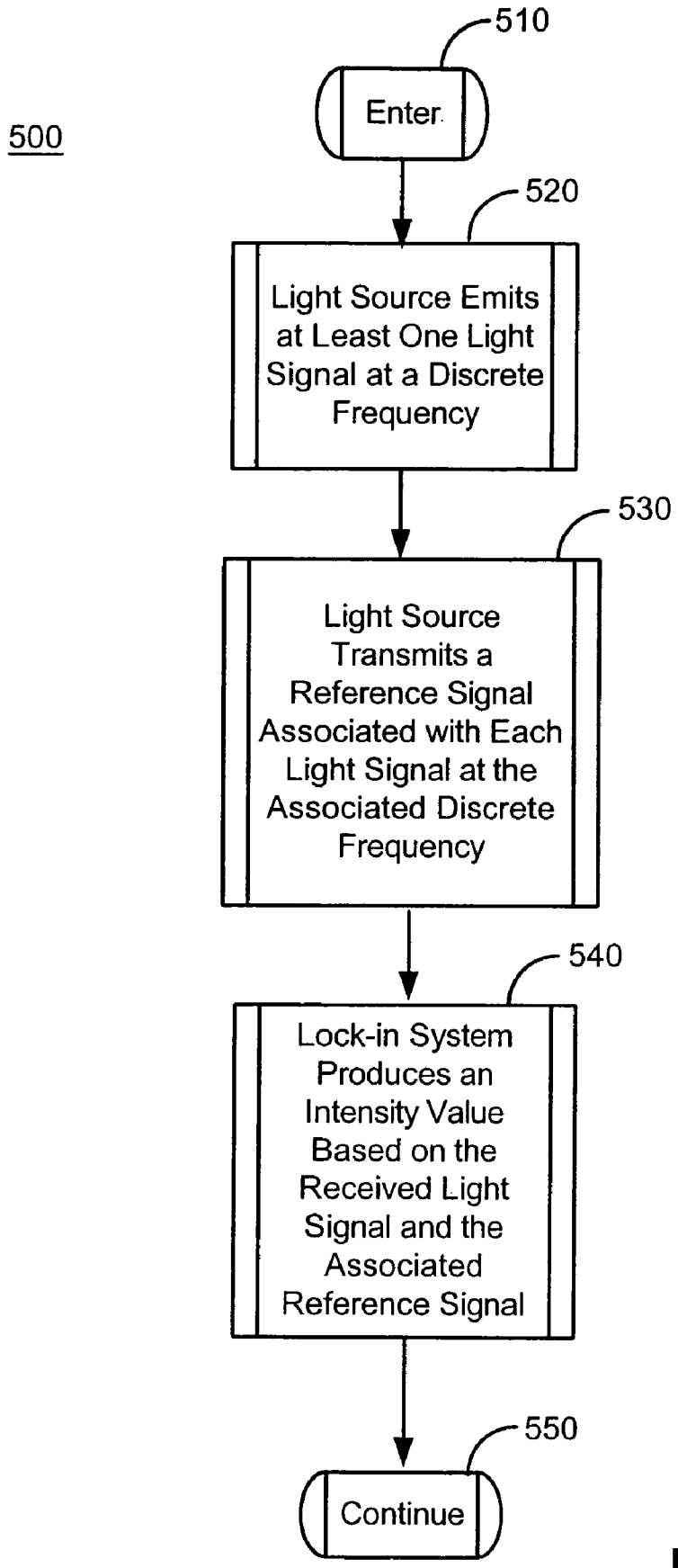
FIG. 5 is a flow-diagram depicting an exemplary method in accordance with the present invention.

FIG. 5 is a flow diagram depicting an exemplary method for sensing intensity of a light source in accordance with the present invention. Method 500 may utilize one or more systems detailed in FIGS. 1-4, above.

Method 500 begins at block 510 where a control system for a light source determines a need to sense the intensity of one or more light emitting diodes (LEDs) or groups of LEDs within the light source. Method 500 allows the control system to determine power requirements for each LED by providing the control system with an intensity value for each LED or group of independently-driven LEDs. Method 500 then advances to block 510.

At block 510, the light source emits a light signal. Referring to FIGS. 1 and 2, the light source includes at least one light emitting diode (LED) or group of LEDs, each independently-driven LED or group of LEDs emitting a light signal that includes an intensity value within the LED's spectral band, and being driven with a current waveform at a discrete frequency.

In an example, the light source includes three LEDs or groups of LEDs, each LED or group of LEDs coupled to and receiving a drive signal from an associated control unit (110, 120, and 130), and combining to produce a "white" light output. That is, LED (115) is driven with an AC current at a frequency $\omega_R$ and emits light in the red spectrum, LED (125) is driven with an AC current at a frequency $\omega_G$ and emits light in the green spectrum, and LED (135) is driven with an AC current at a frequency $\omega_B$ and emits light in the blue spectrum. For illustrative purposes, a cosine waveform is utilized. The resulting light signal is then expressed as:

$$A_R \cos \omega_R t + A_G \cos \omega_G t + A_B \cos \omega_B t$$

where A is the magnitude and $\omega$ is the frequency of the associated signal.

In this example control unit (110) and LED (115) produce the $A_R \cos \omega_R t$ component, control unit (120) and LED (125) produce the $A_G \cos \omega_G t$ component, and control unit (130) and LED (135) produce the $A_B \cos \omega_B t$ component. In this example and referring to FIG. 1, the red LED (115) is driven at 400 Hz ($\omega_R$), the green LED (125) is driven at 500 Hz ($\omega_G$), and the blue LED (135) is driven at 600 Hz ($\omega_B$).

In one embodiment, a square wave is utilized as the waveform characteristics include the ability to set the lower portion of the waveform to zero amps. The ability to set the lower portion of the waveform to zero is important as it allows for cancellation of undesirable components during production of an output intensity signal.

In one embodiment and referring to FIGS. 1 and 3 above, the light signal is received by photodetector 150 and transmitted to each lock-in system (170, 180, and 190) as the received light signal. In another embodiment and referring to FIGS. 3 and 4 above, the light signal is received by photodetectors 450 and 455, and transmitted to each lock-in system (470, 480, and 490) as the received light signal.

In this embodiment, a portion of the received light signal, received by photodetector 450, is transmitted to one lock-in device (475, 485, and 495) within each lock-in system (470, 480, and 490). Additionally, another portion of the signal, received by photodetector 455, is transmitted to the other lock-in device (477, 487, and 497) within each lock-in system (470, 480, and 490). Method 500 then advances to block 520.

At block 520, the control unit transmits a reference signal to an associated lock-in system. In one embodiment and referring to FIG. 1, each control unit (110, 120, and 130) transmits an associated reference signal to an associated lock-in system (170, 180, and 190). In this embodiment, each reference signal is produced by the associated control unit and transmitted at a discrete frequency.

In an example and referring to FIGS. 1 and 2, control unit 210 receives the clock signal and produces the reference signal based on the clock signal. Alternatively and detailed in FIG. 2 above, the frequency could be generated internally within each controller thereby negating the need for an external clock. Additionally, for illustrative purposes a cosine waveform is utilized. The resulting reference signal is then expressed as:

$$I_{ref} \cos \omega_{ref} t$$

where $I_{ref}$ is the magnitude and $\omega_{ref}$ is the frequency of the reference signal.

In this example, the reference signal produced by control unit 120 is expressed as:

$$I_{ref} \cos \omega_G t$$

The reference signal is then transmitted to each lock-in system. In one embodiment, the reference signal is transmitted to each lock-in system (170, 180, and 190) as the reference signal of FIG. 1, above. In another embodiment, the reference signal is transmitted to each lock-in system (470, 480, and 490) as the reference signal of FIG. 4, above. Method 500 then advances to block 530.

At block 530, the lock-in system produces an intensity value based on the received light signal and the associated reference signal. In one embodiment and referring to FIG. 1, each lock-in system (170, 180, and 190) receives the received light signal from photodetector 150 and receives an associated reference signal from an associated control unit (110, 120, and 130).

In an example and referring to FIGS. 1 and 3, signal multiplier 375 of lock-in device 370 receives the received light signal and the associated reference signal. In this example, signal multiplier 375 produces a product signal by multiplying the received light signal by the associated reference signal. The resulting product signal is then expressed as:

$$I_{ref}*A_R \cos \omega_{ref}t \cos \omega_R t+I_{ref}*A_G \cos \omega_G t*\cos \omega_R t+ I_{ref}*A_B \cos \omega_B t*\cos \omega_R t$$

multiplication of the cosine terms results in the product signal expressed as $$\tfrac{1}{2}I_{ref}*A_R \cos(\omega_{ref}-\omega_R)t+\tfrac{1}{2}I_{ref}*A_R \cos(\omega_{ref}+\omega_R)t+ \tfrac{1}{2}I_{ref}*A_G \cos (\omega_{ref}-\omega_G)t+\tfrac{1}{2}I_{ref}*A_G \cos(\omega_{ref}+\omega_G) t+\tfrac{1}{2}I_{ref}*A_B \cos(\omega_{ref}-\omega_B)t+\tfrac{1}{2}I_{ref}*A_B \cos(\omega_{ref}+ \omega_B)t$$

In this example and described above, lock-in device 370 represents the lock-in device within lock-in system 180 of FIG. 1, above. Therefore, the resulting reference signal is produced by control unit 120 and expressed as:

$$I_{ref} \cos \omega_{ref}t=I_{ref} \cos \omega_G t$$

substitution results in the product signal expressed as:

$$\tfrac{1}{2}I_{ref}*A_R \cos(\omega_G-\omega_R)t+\tfrac{1}{2}I_{ref}*A_R \cos(\omega_G+\omega_R)t+ \tfrac{1}{2}I_{ref}*A_G+\tfrac{1}{2}I_{ref}*A_G \cos 2\omega_G t+\tfrac{1}{2}I_{ref}*A_B \cos (\omega_G-\omega_B)t+\tfrac{1}{2}I_{ref}*A_B \cos(\omega_G+\omega_B)t$$

In this example, the product signal is then transmitted to filter 377. Filter 377 is implemented as a low-pass filter having a cutoff frequency that discards the non-dc terms. The cutoff frequency must be less than either $(\omega_G-\omega_R)$ or $(\omega_G-\omega_B)$, for example, below 100 Hz when utilizing the above example frequencies. The result of filtering the product signal is removal of the non-dc terms and is expressed as:

$$\tfrac{1}{2}I_{ref}*A_G$$

In this example and referring to FIGS. 1 and 3, the resulting signal is the intensity value. The reference intensity value may be removed, for example, by "dividing" it out. Alternatively, an unaltered intensity value can be returned to the control system.

In another embodiment and referring to FIG. 4, each lock-in system (470, 480, and 490) receives the received light signal from photodetectors 450 and 455, and receives an associated reference signal from an associated control unit (110, 120, and 130). In this embodiment, one lock-in device of each lock-in system, for example lock-in device 485 of lock-in system 480, receives a portion of the received light signal. The second lock-in device of each lock-in system, for example lock-in device 487 of lock-in system 480, receives another portion of the received light signal. Each lock-in device (485 and 487) produces a component intensity value at the associated intensity signal terminal (Int1/2, Int2/2), as described above. In an example, the component intensity values are summed to produce a single intensity value for the associated spectrum (e.g. Green). In an example, the ratio of the two components values provides a measure of any spectral shifts that may have occurred during light source operation. Method 500 then advances to block 550, where it returns the intensity values to the control system.

The control system utilizes the intensity values to determine the amount of power to supply to the LEDs of the light source. In one embodiment and referring to FIG. 1, the control system determines power adjustment requirements by cross indexing each provided LED intensity value with a thermal value (already received). In an example, each provided LED intensity value and thermal value are cross indexed in a look-up table that includes manufacturer provided data and/or data obtained from LED calibration in the factory. The resultant value obtained from the look-up table, for each LED, is then utilized by the control system to determine an actual contribution of each LED or independently-driven LED group to the light source. Power supplied to each LED is then adjusted accordingly.

In another embodiment and referring to FIG. 4, the control system determines power adjustment requirements by cross indexing each provided summed LED intensity value with a ratio of the component intensity values in a look-up table that includes manufacturer provided data and/or data obtained from LED calibration in the factory. The resultant value obtained from the look-up table, for each LED or independently-driven LED group, is then utilized by the control system to determine an actual contribution of each LED to the light source. Power supplied to each LED is then adjusted accordingly.

The above-described apparatus and method for sensing light emitted simultaneously from multiple light sources are example methods and implementations. These methods and implementations illustrate one possible approach for sensing light emitted simultaneously from multiple light sources. The actual implementation may vary from the method discussed. Moreover, various other improvements and modifications to this invention may occur to those skilled in the art, and those improvements and modifications will fall within the scope of this invention as set forth in the claims below.

The present invention may be embodied in other specific forms without departing from its spirit or essential characteristics. The described embodiments are to be considered in all respects only as illustrative and not restrictive.

The invention claimed is:

1. A light source control apparatus comprising:

a plurality of light sources, each light source emitting both a light signal at a discrete frequency and a reference signal at the discrete frequency, each light source having a different discrete frequency;

a photodetector optically coupled to the plurality of light sources, the photodetector designed to receive the light signals from the plurality of light sources and to produce a received light signal based on the light signals from the plurality of light sources; and a plurality of lock-in systems coupled to the photodetector to receive the received light signal, each lock-in system further being coupled to and associated with one of the plurality of light sources to receive the reference signal from the associated one of the plurality of light sources;

wherein each lock-in system produces an intensity value for the associated one of the plurality of light sources based on the received light signal and the reference signal from the associated one of the plurality of light sources.

2. The apparatus of claim 1 wherein each light source comprises:

a control unit; and a light emitting diode (LED) designed to receive a drive signal from the control unit and produce the light signal based on the drive signal.

3. The apparatus of claim 2 wherein the control unit is designed to receive a clock signal and a power signal, produce the reference signal at the discrete frequency based on the clock signal, and produce the drive signal based on the reference signal and the power signal.

4. The apparatus of claim 2 wherein the light emitting diode for each of the plurality of light sources generates light at a different spectral light output.

5. The apparatus of claim 4 wherein the light emitting diode for a first one of the plurality of light sources generates red light, the light emitting diode for a second one of the plurality of light sources generates green light, and the light emitting diode for a third one of the plurality of light sources generates blue light.

6. The apparatus of claim 1 wherein the photodetector comprises a single-junction photodiode.

7. The apparatus of claim 1 wherein the intensity value for the associated one of the plurality of light sources is the intensity for the associated one of the plurality of light sources of the light signal at the associated discrete frequency.

8. The apparatus of claim 1 wherein each lock-in system comprises:

a frequency multiplier; and a filter, the filter coupled to the frequency multiplier;

wherein the intensity value for the associated one of the plurality of light sources is the product of the received light signal and the reference signal from the associated one of the plurality of light sources processed through the frequency multiplier, and filtered to remove non-dc portions.

9. The apparatus of claim 8 wherein the filter is a low-pass filter.

10. The apparatus of claim 1 wherein the photodetector comprises a multi-junction photodiode.

11. The apparatus of claim 10 wherein each junction of the multi-junction photodiode is designed to receive the light signals from the plurality of light sources and to produce the received light signal within a predetermined spectrum based on the light signals from the plurality of light sources.

12. The apparatus of claim 11 wherein each of the plurality of lock-in systems comprises a plurality of lock-in devices, each lock-in device being coupled to the photodetector to receive the received light signal within a predetermined spectrum for an associated junction of the multi-junction diode.

13. The apparatus of claim 12 wherein each lock-in device comprises:

a frequency multiplier; and a filter, the filter coupled to the frequency multiplier;

wherein a partial intensity value for the associated one of the plurality of light sources is produced from the product of the received light signal within a predetermined spectrum for an associated junction of the multi-junction diode received by the lock-in device and the reference signal from the associated one of the plurality of light sources processed through the frequency multiplier, and filtered to remove non-dc portions.

14. The apparatus of claim 13 wherein the intensity value is the sum of the partial intensity values for the plurality of light sources.

15. The apparatus of claim 13 wherein the filter is a low-pass filter.

16. The apparatus of claim 1 wherein the photodetector is a first photodetector, the received light signal is a first received light signal, and the plurality of lock-in systems is a plurality of first lock-in devices, further comprising:

a second photodetector optically coupled to the plurality of light sources, the second photodetector designed to receive the light signals from the plurality of light sources and to produce a second received light signal based on the light signals from the plurality of light sources;

a plurality of second lock-in devices coupled to the second photodetector to receive the second received light signal, each second lock-in device further being coupled to and associated with one of the plurality of light sources to receive the reference signal from the associated one of the plurality of light sources;

wherein each second lock-in device produces a second intensity value for the associated one of the plurality of light sources based on the second received light signal and the reference signal from the associated one of the plurality of light sources.

* * * * *